United States Patent [19]

Boerigter

[11] 4,375,707

[45] Mar. 8, 1983

[54] INVALID BED

[75] Inventor: Milton E. Boerigter, Hamilton, Mich.

[73] Assignee: Fleetwood Furniture Company, Zeeland, Mich.

[21] Appl. No.: 236,860

[22] Filed: Feb. 23, 1981

[51] Int. Cl.[3] ..... A61G 7/10

[52] U.S. Cl. ..... 5/81 R; 5/83; 5/87; 5/445; 5/503

[58] Field of Search ..... 5/81-89, 5/445, 503, 508; 414/921

[56] References Cited

U.S. PATENT DOCUMENTS

| | | | |
|---|---|---|---|
| 1,840,170 | 1/1932 | Neils | 5/445 |
| 3,148,915 | 9/1964 | Connolly | 5/2 R |
| 4,092,748 | 6/1978 | Ewers | 5/82 X |

FOREIGN PATENT DOCUMENTS

| | | | |
|---|---|---|---|
| 1473537 | 3/1967 | France | 5/84 |

*Primary Examiner*—Francis K. Zugel
*Assistant Examiner*—Michael F. Trettel
*Attorney, Agent, or Firm*—Price, Heneveld, Huizenga & Cooper

[57] ABSTRACT

An invalid bed includes a frame and an overhead support structure which provides an elevated diagonally extending support surface for a pivot arm. The pivot arm is pivotally anchored to a corner post and extends over and is supported by the support surface. The pivot arm swings from a position at the side of the bed frame to its center and includes a strap which an invalid can grasp for elevating himself and swinging onto or out of the bed.

20 Claims, 7 Drawing Figures

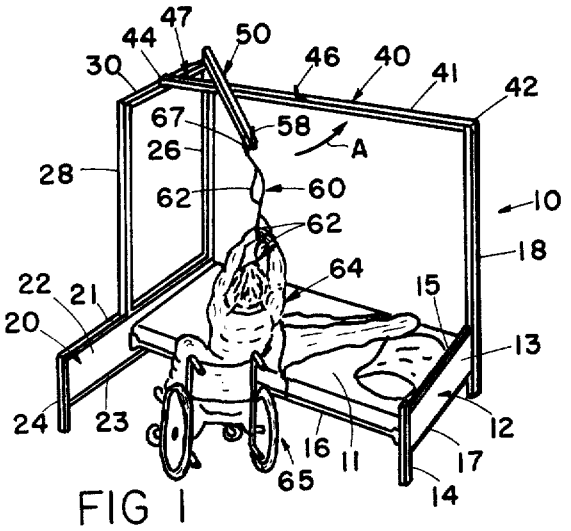
FIG 1
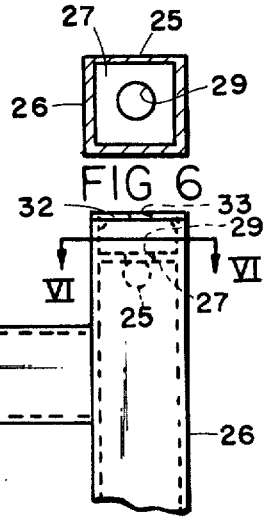
FIG 6
FIG 5
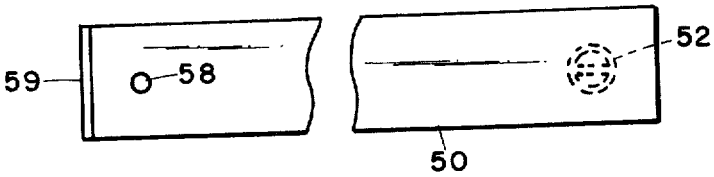
FIG 2
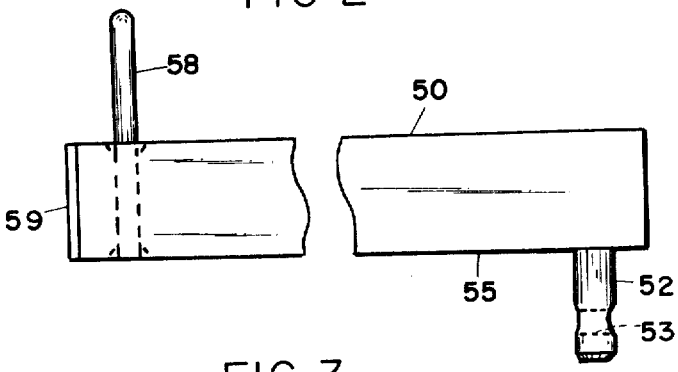
FIG 3
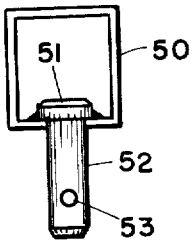
FIG 4

INVALID BED

BACKGROUND OF THE INVENTION

The present invention relates to an invalid bed and particularly to one which includes means for assisting an invalid into and out of the bed.

Invalids and particularly parapalegiacs have tremendous difficulty in getting into and out of beds. Either they need assistance from another person or must rely upon their own strength and limited mobility in a time consuming effort to transfer themselves between a wheelchair and the bed.

Some apparatus has been proposed for use in connection with invalid beds, as for example represented in U.S. Pat. Nos. 884,393, 1,505,437, 1,698,754, and 3,077,613. The prior art represented by these patents disclose relatively complicated bed structures made for invalids and in which to some extent trapeze mechanism is provided either for transferring a patient into and out of the bed or providing for exercise of the invalid once in bed. Such structure is complex and necessarily expensive for home use. Also, some of the equipment is so complicated that it still requires a second person to operate, thereby leaving the invalid dependent on other persons. One of the major goals of any rehabilitation program naturally is to help the patient become as independent as possible to improve both his phychological and physiological well-being.

SUMMARY OF THE PRESENT INVENTION

The invalid bed of the present invention recognizes the needs of handicapped individuals and particularly parapalegiacs by providing an invalid bed of relatively simplified construction and one which permits an invalid to transfer himself to and from the bed without assistance from another person. The invalid bed of this invention is relatively attractive and readily useable in the home environment either by itself or in connection with a storage unit to provide a living center for the invalid.

The invalid bed of the present invention includes a base for supporting a mattress and means defining a diagonally and horizontally extending support surface which in the preferred embodiment includes vertically and upwardly extending posts at opposite ends of the base with the post means at one end longitudinally offset from the post means at the other end and a horizontally extending cross support supported at opposite ends to the upper ends of the post means. A pivot arm slidably rests on the cross support and is pivotally anchored at one end to one of the post means and includes gripping means extending downwardly for permitting an individual to swing into and out of the bed supporting his weight on the sliding pivot arm which swings toward and away from the center of the bed.

In one embodiment of the invention, the base and post means support storage shelves and compartments readily accessible to the occupant of the bed for providing convenient access to personal care and other items.

These and other objects, features and advantages of the bed of the present invention will become apparent upon reading the following description thereof together with reference to the accompanying drawings in which:

BRIEF DESCRIPTION OF THE DRAWINGS

FIG. 1 is a perspective view of an invalid bed of the present invention;

FIG. 2 is an enlarged fragmentary top plan view of a pivot arm employed in the invalid bed of the present invention;

FIG. 3 is a front elevational view of the structure shown in FIG. 2;

FIG. 4 is a right end elevational view of the structure shown in FIG. 3;

FIG. 5 is an enlarged fragmentary front elevational view of anchor means for the pivot arm shown in FIGS. 1 through 4;

FIG. 6 is a cross elevational view taken along section lines VI—VI of FIG. 5.

DETAILED DESCRIPTION OF THE PREFERRED EMBODIMENT

Figure 7:
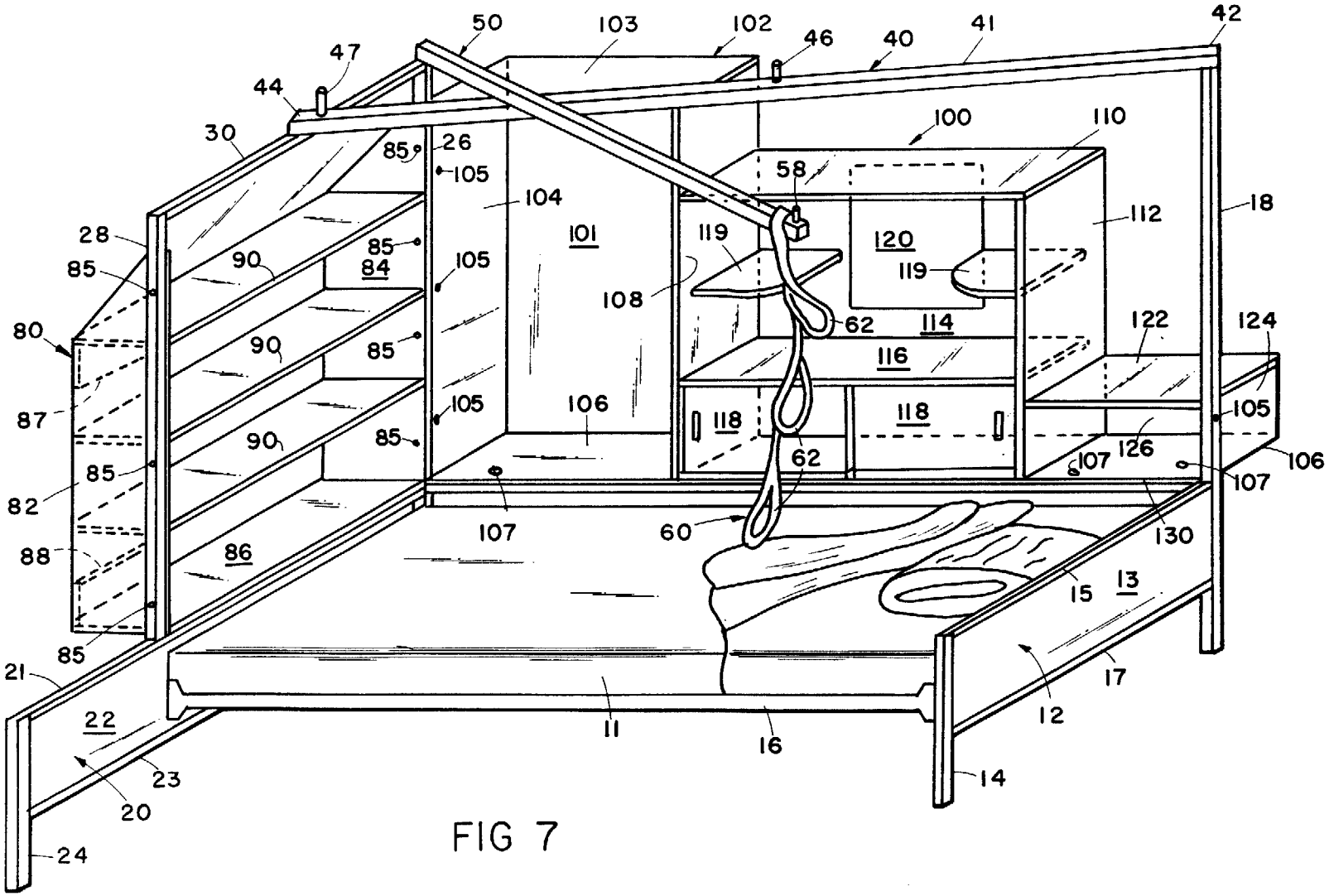
FIG. 7 is a perspective view of an alternative embodiment of the present invention.

Referring initially to FIG. 1 there is shown an invalid bed 10 of the present invention which consists of a base or frame defined by a headboard 12 and a footboard 20 secured to one another by longitudinally extending mattress supporting struts 16 horizontally spaced from one another a distance to provide support for a box spring and mattress 11 of conventional size. Headboard 12 comprises a panel 13 supported by a frame work consisting of a corner leg 14, an upper horizontally extending leg 15; a lower horizontal leg 17, and a vertically and upwardly extending post means 18. Post 18 as seen in FIG. 1 extends upwardly significantly higher than support leg 14, and in the preferred embodiment, a height of approximately 75 inches. The frame defined by leg 14 members 15 and 17 and post means 18 is constructed of 1¼ inch tubular steel welded in a conventional manner and to which the head panel 13 is conventionally secured. Panel 13 has a width of approximately 37 inches in the preferred embodiment corresponding roughly to the normal headboard width for a twin sized bed.

The footboard 20 includes a panel 22 supported by framework comprising a support leg 24, upper and lower support members 21 and 23 respectively extending horizontally from leg 24 and corner post means 26 extending upwardly a distance substantially equal to the height of post means 18. In addition, the frame for footboard 20 further includes upwardly extending post means 28 positioned approximately 2 feet inwardly from leg 24 and positioned generally in longitudinal alignment with leg 14 of the headboard. A horizontal support member 30 extends between and is welded to the upper ends of post means 26 and 28 to form an inverted U-shaped support frame having a height in the preferred embodiment of approximately 75 inches. Like the frame for headboard 12, this framework structure for footboard 20 is also made of 1¼ inch tubular steel welded at the junctions thereof to provide a rigid support structure. The longitudinal bed rails 16 are secured to the head and footboards by conventional fastening means.

Secured between post means 18 and the U-shaped frame at the foot end of the bed is a horizonally extending cross support 40 having one end 42 secured to the top of post means 18 and an opposite end 44 secured to the horizontal member 30 at a position approximately midway between support posts 26 and 28. Thus, end 44 of the diagonally extending support member 40 is offset from end 42 with respect to the longitudinal axis of the bed. Ends 42 and 44 are secured to post 18 and member 30 respectively by conventional means such as bolts or the like secured to plates welded within the tubular members in a conventional manner. Cross member 40 however is reinforced and comprises in the preferred embodiment 1½ inch tubular steel of square cross section with a 1 inch tubular steel insert to provide greater rigidity for the member. Members 18, 26, 28,30 and 40 define an elevated diagonally extending horizontally support surface to provide a continuous support area for the pivot arm now described.

Pivotally anchored to the upwardly extending frame of the footboard at a position spaced from end 44 of member 40 is a pivot arm 50 which slidably rests on the upper surface 41 of cross member 40. Pivot arm 50 is anchored in the preferred embodiment to the upper end of vertically extending post 26 by means of an anchor pin 52 (FIGS. 2–4) having a head 51 welded to the interior wall of the tubular steel member 50 as best seen in FIG. 4 and a downwardly depending shank including a transverse aperture 53 extending therethrough. Post 26 includes a recessed horizontally extending rectangular plate 27 welded to the interior of the post near the top end thereof as seen in FIGS. 5 and 6. Plate 27 includes an aperture 29 through which pin 52 projects with aperture 53 being located just beneath plate 27. The rear wall of post 26 includes an aperture 25 permitting a locking pin such as a compressible roll pin to be inserted through aperture 53 of pin 52 once positioned through aperture 29. A nylon cap 32 (FIG. 5) is positioned over the top end of post 26 prior to assembly of the pivot arm thereon to provide a lubricious interconnection between pivot arm 50 and the upper end of post 26. The cap includes an aperture 33 permitting the extension of pin 52 therethrough. Cap 32 is of conventional construction to snap fit within the 1¼ inch square post 26.

As seen in FIG. 5, the height of frame member 28 is selected such that horizontal cross member 30 extends slightly below the upper end of post 26 such that the lower surface 55 of pivot arm 50 is positioned in vertical coincidence with the upper surface 41 of cross member 40 when the pivot arm is installed in the socket means defined by the upper end structure of post 26. In order to limit the pivotal motion of cross arm 50 in a direction indicated by arrows A in FIG. 1, vertically extending pins 46 and 47 are secured to cross member 40 thereby defining a stop which pivot arm 50 engages to limit the motion of the pivot arm such that it will remain on the diagonally extending cross member 40 and be slidably supported by it at all times when in an operative position.

At the end of pivot arm 50 remote from its pivotable anchoring mechanism there is provided an upwardly extending pin 58 and gripping means comprising a 1½ inch nylon strap 60 having a plurality of loops 62 therein at vertically spaced intervals permitting an individual 64 depicted in a wheelchair 65 in FIG. 1 to progressively lift himself from the wheelchair upwardly and be supported by the strap 60 which in turn is looped over the end of pivot arm 50 by means of a loop 67. Pin 58 thereby prevents the strap 60 from sliding off of pivot arm 50 while permitting the nylon strap 60 to be slid along bar 50 as desired for different degrees of control. As seen in FIG. 3, pin 58 extends through the tubular pivot arm 50 and is welded to the interior walls thereof and an end cap 59 is secured to the end of member 50 for decorative purposes as are caps to the remaining open ends of the tubular steel framework forming the bed.

In use, as the invalid raises himself from the wheelchair or other support structure, he can swing himself in a direction indicated by arrow A, using the momentum of the swinging body to pivot arm 50 about pivot pin 52 in post 26 which in turn slides the pivot arm over the upper surface 41 of cross member 40 providing a support for the body weight. The anchor pin extending through aperture 53 of the pivot pin 52 prevents the end of the pivot arm from lifting upwardly during use. With some practice, an invalid such as a parapalegiacs can without assistance employ the invalid bed of the present invention to assist himself into and out of the bed employing the pivoted support arm to carry and transfer his weight from a position adjacent the side of the bed to the center portion of the bed. In the preferred embodiment of the invention the pivot arm 50 had a length of approximately 57½ inches while the reinforced support arm 40 had a length of approximately 85 inches for the approximately 80 inch long bed. The 2 foot extension of footboard assembly 20 provides additional stability to the bed when the users weight is placed on the end of pivot arm 50 when in an extended position as shown in FIG. 1. By positioning one end of support 40 at one corner of the headboard and its opposite end midway at the foot end of the bed, the pivot arm advantageously will position the user in the middle portion of the bed when moved to the stopped position thereby centrally locating the individual within the bed.

In an alternative embodiment of the invention shown in FIG. 7, identical structural members are identified by the same reference numerals as shown in FIG. 1. In addition to the basic invalid bed structure, the structure shown in FIG. 7 includes a footboard shelf assembly 80 and a side cabinet and shelf assembly 100. Assembly 80 is secured between posts 26 and 28 by means of trapezoidal side panels 82 and 84 which are secured to the posts by means of bolts 85 vertically spaced along the posts. Cabinet unit 80 includes a floor 86 extending between endwalls 82 and 84, a pair of vertically spaced backwalls 87 and 88 extending between endwalls 82 and 84 also are a plurality of vertically spaced shelves 90 for receiving objects such as a television or the like which conveniently would be located at the foot of the user's bed.

The side cabinet and shelf assembly 100 includes a generally rectangular wardrobe unit 102 having a rear wall 101, a top 103, a first sidewall 104 secured to posts 26 by means of bolts 105, a floor 106 and a second sidewall 108 with each of the five sides being conventionally interconnected to each other. Unit 100 also includes lockable sliding doors and shelf section comprising a first top member 110 joined to sidewall 108 at one end and to a sidewall 112 at its opposite end. A rear wall 101 extends at its lower end to floor 106 of wardrobe 102 which floor extends the length of the bed. A first shelf 116 is provided and defines a point of rest for a tackboard that covers the rear wall 101 and a top of a sliding storage area including sliding doors 118 to provide an enclosed compartment for the storage of personal items therein. A pair of quarter-round shelves 119 are provided in the corners of unit 100 and a mirror 120 is provided on the tackboard 114. Another open storage compartment is provided by a second horizontal extending top member 122, and end wall 124 which is secured to post 18 by means of bolt 105, and rear wall 126 as shown in FIG. 7. The interconnection of the various shelves, panels and walls is conventional and such members can be made from particle board with vinyl or other bonded surface coatings and secured to the bed frame by bolts 105 and bolts 107 securing the floor 106 to a horizontally extending support rail 130 bolted between vertical support posts 26 and 18 along the length thereof. The shelf and cabinet construction when integrated with the bed as shown provides an invalid with a convenient living center.

It will become apparent to those skilled in the art that various modifications to the preferred embodiments of the invention described and disclosed herein can be made. Such modifications made for example include varying the dimensions to provide a full or even larger size bed and providing independent vertically extending posts for supporting the ends of cross member 40 and pivot member 50 instead of the U-shaped frame structure shown. These and other modifications to the preferred embodiments of the invention will, however, fall within the spirit and scope of the present invention as defined by the appended claims.

The embodiments of the invention in which an exclusive property or privilege is claimed are defined as follows:

1. An invalid bed comprising:

a support frame for a mattress;

means secured to said frame for defining a horizontally extending support surface extending diagonally from one end of said frame to an opposite end thereof;

a generally horizontally extending pivot arm pivotally anchored at one end to said frame above said means defining a support surface such that said pivot arm is continuously supported by said support surface and is freely moveable thereon, said means defining a support surface being sufficiently above said frame to provide clearance thereunder for an individual; and gripping means extending from said pivot arm for assisting an individual to move into and out of the bed without assistance by hanging onto said gripping means and swinging into or out of the bed.

2. The bed as defined in claim 1 wherein said means for defining a support surface comprises generally vertically extending post means at opposite ends of said frame and diagonally extending generally horizontal support means extending between and supported by said post means, said support means having an upper surface providing said support surface.

3. The bed as defined in claim 2 wherein said post means includes a pair of vertically extending posts secured to said frame at one end in horizontally spaced relationship to one another.

4. An invalid bed comprising:

a support frame for a mattress;

means secured to said frame for defining a support surface extending diagonally from one end of said frame to an opposite end thereof;

a generally horizontally extending pivot arm pivotally anchored at one end to said frame above said means defining a support surface such that said pivot arm is continuously supported by said support surface as it moves, said means defining a support surface being sufficiently above said frame to provide clearance therunder for an individual; and gripping means extending from said pivot arm for assisting an individual to move into and out of the bed by hanging onto said gripping means and swinging into or out of the bed, wherein said means for defining a support surface comprises generally vertically extending post means at opposite ends of said frame and diagonally extending generally horizontal support means extending between and supported by said post means, said support means having an upper surface providing said support surface, wherein said post means includes a pair of vertically extending posts secured to said frame at one end in horizontally spaced relationship to one another, and wherein said pivot arm is pivotally anchored to an upper end of one post of said pair of posts.

5. The bed as defined in claim 4 wherein said gripping means comprises a strap extending downwardly from said pivot arm.

6. The bed as defined in claim 5 wherein said strap includes a plurality of vertically spaced loops.

7. The bed as defined in claim 6 wherein said frame includes an extension located at least at one end of said frame for providing a widened base of support for said bed.

8. The bed as definedd in claim 7 wherein said extension is located at the same end of said bed as said pair of posts.

9. The bed as defined in claim 8 and further including storage means secured to said frame and posts for providing storage areas accessible to a person in said bed.

10. The bed as defined in claim 9 wherein said storage means includes shelf means extending along the foot and along one side of said bed.

11. An invalid bed comprising:

a base for supporting a mattress;

generally vertical and upwardly extending post means at opposite ends of said base with the post means at one end longitudinally offset from the post means at the other end;

a generally horizontally extending cross support extending between and supported by upper ends of said post means; and a pivot arm freely slidably resting on said cross support and pivotally anchored at one end to one of said post means and including gripping means extending downwardly permitting a user to pivot himself into and out of the bed without assistance by hanging onto said gripping means while moving said pivot arm toward and away respectively, from the center of the bed.

12. The bed as defined in claim 11 wherein one of said post means includes a pair of vertically extending posts secured to said base in horizontally spaced relationship.

13. An invalid bed comprising:

a base for supporting a mattress;

generally vertical and upwardly extending post means at opposite ends of said base with the post means at one end longitudinally offset from the post means at the other end;

a generally horizontally extending cross support extending between and supported by upper ends of said post means; and a pivot arm slidably resting on said cross support and pivotally anchored at one end to one of said post means and including gripping means extending downwardly permitting a user to pivot himself into and out of the bed by hanging onto said gripping means while moving said pivot arm toward and away respectively, the center of the bed, wherein one of said post means includes a pair of vertically extending posts secured to said base in horizontally spaced relationship, and wherein said pivot arm is pivotally anchored to an upper end of one post of said pair of posts and said post means further includes a generally horizontally extending support extending between said pair of posts and said cross support has one end secured to said generally horizontally extending support and an opposite end secured to post means at the opposite end of said bed.

14. The bed as defined in claim 13 wherein said gripping means comprises a strap extending downwardly from said pivot arm and including a plurality of vertically spaced loops.

15. The bed as defined in claim 14 wherein said base includes an extension located at least at one end of said base for providing a widened base for support for said bed.

16. The bed as defined in claim 15 wherein said extension is located at the same end of said bed as said pair of posts.

17. The bed as defined in claim 16 and further including storage means secured to said base and posts for providing storage areas accessible to a person in said bed.

18. The bed as defined in claim 17 wherein said storage means includes shelf means extending along the foot and along one side of said bed.

19. An invalid bed comprising:

a support frame for a mattress;

means secured to said frame for defining a horizontally extending support surface extending diagonally from one end of said frame to an opposite end thereof;

a generally horizontally extending pivot arm pivotally anchored at one end to said frame above said means defining a support surface such that said pivot arm is continuously supported by said support surface and is freely moveable thereon, said means defining a support surface being sufficiently above said frame to provide clearance thereunder to an individual;

gripping means extending from said pivot arm for assisting an individual to move into and out of the bed by hanging onto said gripping means and swinging into or out of the bed without assistance; and storage means secured to said frame and means defining a support surface for providing storage areas accessible to a person in said bed.

20. The bed as defined in claim 19 wherein said storage means includes shelf means extending along the foot and along one side of said bed.

* * * * *